US006964081B1

(12) United States Patent
Clement et al.

(10) Patent No.: US 6,964,081 B1
(45) Date of Patent: Nov. 15, 2005

(54) SOFT FLOOR SCRUBBER

(76) Inventors: David E. Clement, 42 Mesquite Village Cir., Henderson, NV (US) 89012; James G. Campbell, 2017 Joy View La., Henderson, NV (US) 89102; Joseph J. Guzik, 10530 Abbotsbury Dr., Henderson, NV (US) 89102; Peter D. Magdos, 8487 Bandits Bluff Ave., Las Vegas, NV (US) 89143

( * ) Notice: Subject to any disclaimer, the term of this patent is extended or adjusted under 35 U.S.C. 154(b) by 0 days.

(21) Appl. No.: 10/605,740

(22) Filed: Oct. 22, 2003

Related U.S. Application Data

(60) Provisional application No. 60/319,643, filed on Oct. 22, 2002.

(51) Int. Cl.[7] ..... A47L 11/30
(52) U.S. Cl. ..... 15/320; 15/340.4; 15/359; 15/384
(58) Field of Search ..... 15/320, 340.1, 15/340.4, 359, 322, 384

(56) References Cited

U.S. PATENT DOCUMENTS

| | | | | |
|---|---|---|---|---|
| 2,973,544 A | * | 3/1961 | Romaniuk | 15/359 |
| 3,550,181 A | * | 12/1970 | Burgoon et al. | 15/320 |
| 3,702,488 A | | 11/1972 | Kasper | |
| 3,833,961 A | | 9/1974 | Fortman et al. | |
| 3,837,029 A | | 9/1974 | Kasper | |
| 3,879,789 A | | 4/1975 | Kasper | |
| 4,037,289 A | | 7/1977 | Dojan | 15/320 |
| 4,822,431 A | | 4/1989 | Bricher et al. | 134/28 |
| 4,845,801 A | * | 7/1989 | Milly et al. | 15/340.1 |
| 5,347,678 A | * | 9/1994 | Williams et al. | 15/359 |
| 5,465,456 A | | 11/1995 | Fellhauer et al. | 15/320 |
| 5,687,443 A | | 11/1997 | Moore | 15/98 |
| 5,873,138 A | | 2/1999 | Geyer et al. | 15/50.1 |
| 5,901,407 A | * | 5/1999 | Boomgaarden | 15/320 |
| 6,131,240 A | * | 10/2000 | Shark et al. | 15/320 |
| 6,295,682 B1 | | 10/2001 | Klucznik | 15/50.1 |
| 6,684,452 B2 | * | 2/2004 | Lehman et al. | 15/320 |
| 6,735,812 B2 | * | 5/2004 | Hekman et al. | 15/320 |
| 2002/0014259 A1 | * | 2/2002 | Hahnl | 15/320 |

* cited by examiner

*Primary Examiner*—Theresa T. Snider
(74) *Attorney, Agent, or Firm*—Kenehan & Lambertsen; John C. Lambertsen

(57) ABSTRACT

An operator driven, ridable carpet cleaning machine is provided with a pressurized cleaning solution spray applicator located forward of a counter-rotating pair of cylindrical brushes and a pair of articulating vacuum shoes. The pressurized spray enables the delivery of sufficient cleaning solution, with agitation of the soft, carpeted surface enhanced by the counter-rotating brushes. Articulation of the vacuum shoes enables them to remain in close contact with the carpeting, maximizing the removal of the applied cleaning solution.

1 Claim, 2 Drawing Sheets

SOFT FLOOR SCRUBBER

CROSS REFERENCE TO RELATED APPLICATIONS

This application claims the benefit of U.S. Provisional Patent Application Ser. No. 60/319,643, filed Oct. 22, 2002.

BACKGROUND OF INVENTION

1. Field of the Invention

The present invention relates generally to cleaning and dusting apparatus and, more particularly, to self-propelled power driven scrubbing machines. More specifically, the present invention relates to a propelled rider scrubber for carpeted surfaces that cleans by applying a cleaning solution, scrubbing the wetted carpet, and extracting dirt and moisture from the treated carpet.

2. Description of the Prior Art

First impressions are important, and for most commercial establishments the floor is the first surface noticed by most visitors and guests. "If your floors shine, your facility shines" is a phrase that particularly applies to the hospitality industry. The "cast" of cleaners at Disneyland and its companion Disney California Adventure must service hundred of areas and buildings, in addition to 400,000 square feet of sidewalks. It is a task that keeps 1,100 employees busy day and night.

Hotels, casinos, exhibition halls, and airports have an even more difficult task. Many are open 24/7/365, with regular traffic in nearly all areas of the facility, from both guests and staff. A visit to almost any Las Vegas casino late at night will find employees polishing floors and tending to carpets. Entrance carpeting is often extracted daily to maintain a bright, like-new appearance. Convention areas have become ever more important revenue sources, and present myriad cleaning problems. In addition to high levels of foot traffic, conventions require exhibit and meeting room set up and teardown. In busy convention centers, banquets run breakfast, lunch, and dinner.

Just as dust and grit are the bane of polished hard floors, their removal from carpeting is essential to good looks and long carpet life. In addition to a daily spot removal regimen, a balanced carpet-cleaning program includes frequent vacuuming to remove surface soils in high traffic areas, and less frequent deep cleaning to remove adhered and accumulated soiling not touched by the other removal techniques.

From a health standpoint, deep soil removal on a regular basis would seem far better than interim spot-removal and surface vacuuming. Additionally, such treatment would maintain the carpeting in a like-new condition for a far longer period of time, as well as decreasing the other problems associated with carpet contaminants. For reasons of both cost and convenience, the general trend is away from the deep cleaning wet system in medium and large facilities.

The main expense in floor care maintenance is the cost of labor, which may amount to over 90% of an operational budget. Presently available deep cleaning/wet systems can treat at most 400–500 square feet per hour over an eight-hour shift. This pace translates into a labor cost that cannot compete with the more superficial interim methods, such as absorbent pad cleaning or dry foam extraction.

The higher speed cleaning processes are also usually low-moisture systems. For areas requiring a rapid "turn," such systems offer the advantage of rapid drying. With some venues having foot traffic 24 hours a day, rapid drying is essential to full facility utilization. A need exists to provide fully utilized facilities with the ability to deeply clean carpeted surfaces at a more rapid rate than is presently provided while also extracting a greater amount of moisture to effect a more rapid drying than has previously been possible when deep cleaning.

SUMMARY OF INVENTION

According to the present invention, an operator driven, ridable carpet cleaning scrubber utilizes a pair of counter-rotating cylindrical brushes and a liquid spray manifold located forward of the brushes to apply cleaning solution prior to agitation of the carpeted surface to be cleaned. A pair of articulating vacuum shoes maximizes the application of suction to the varying surfaces of the brushed carpet, enhancing the removal of cleaning solution from the cleaned carpet.

Preferably the spray manifold is provided with a plurality of spray nozzles, extending the length of the cylindrical brushes. A pump is also preferably provided to enable a sufficient flow of cleaning solution through the manifold and spray nozzles.

As another aspect of the present invention, these structural features can easily be retrofitted to a hard surface cleaner. Counter-rotating brushes are also used to clean hard (non-carpeted) surfaces, and frequently employ a gravity-fed cleaning fluid applicator that directs the fluid to the rotating brushes. Soft (carpeted) floors require the application of significantly more cleaning fluid, which is provided by the addition of a fluid pump and a spray manifold assembly. Locating the application spray nozzles forward of the counter-rotating brushes enables the saturation of the carpeted surface prior to the agitation thereof by the rotating brushes.

Hard surface scrubbers utilize vacuum squeegees to remove any applied cleaning fluid. Squeegee operation over a soft (carpeted) surface is not efficient. Additionally, carpeted surfaces frequently have dips and ridges due to variations in the underlying supporting surface. Replacement of the squeegee by a pair of vacuum shoes enhances the application of suction to the carpeted surface. Enabling the shoes to mutually articulate further enhances the application of suction to the carpet, permitting the shoes to individually follow the dips and ridges in the carpeted surface.

Other objects, features, and advantages of the invention should be apparent from the following description of the preferred embodiment thereof as illustrated in the accompanying drawings.

DETAILED DESCRIPTION

Figure 1:
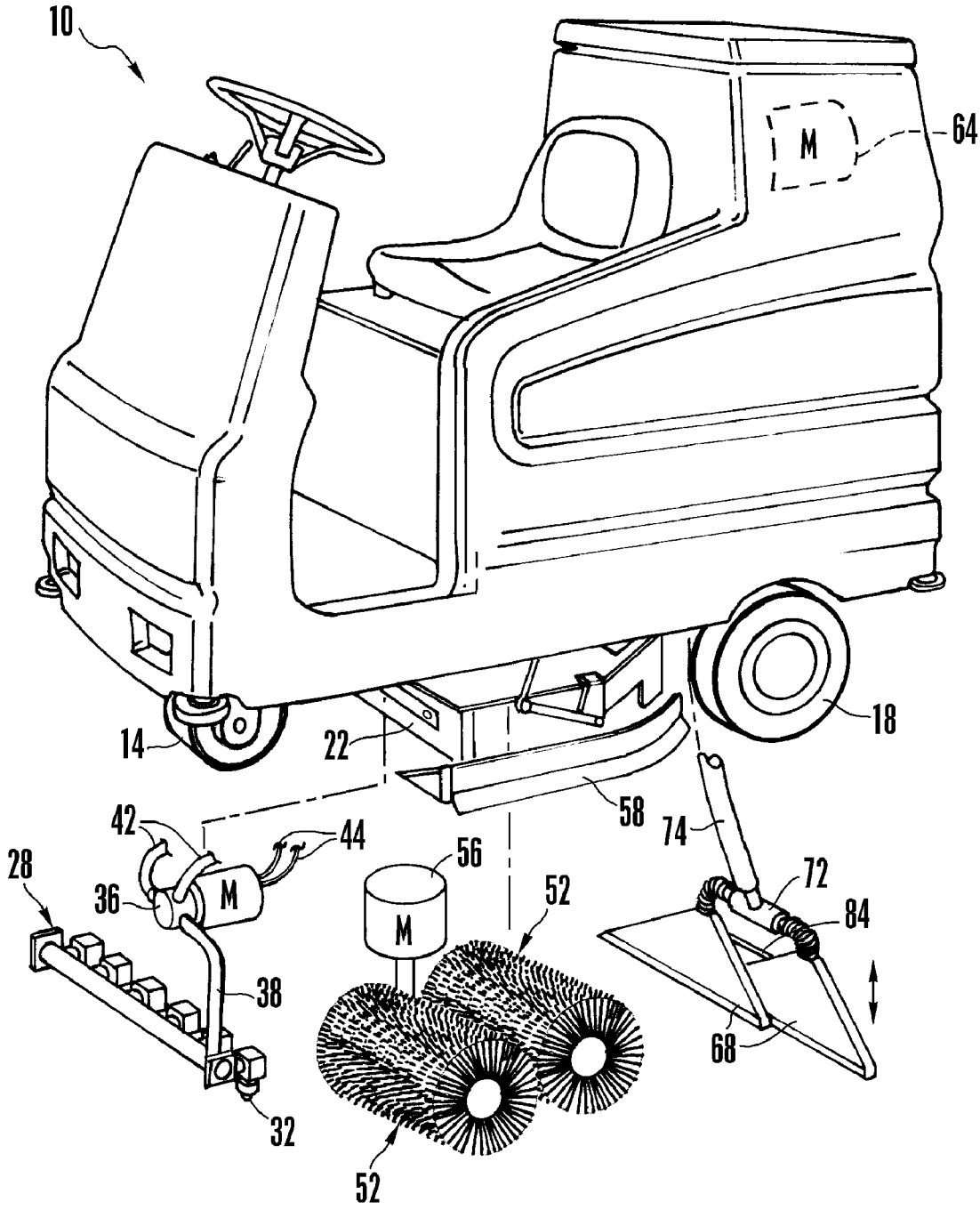
FIG. 1 is a partially exploded perspective view, with portions in phantom, showing a power scrubber as modified in accordance with the present invention.

Reference is now made to the drawings wherein like numerals refer to like parts throughout. In FIG. 1, an automatic or power scrubber 10 is shown, having a front drive wheel 14 and a pair of rear support wheels 18 (only one shown in FIG. 1) that permit an operator to ride during the performance of various cleaning operations. The power scrubber 10 functions as a support framework for the present invention, and by itself, is well known to the facilities maintenance industry.

Such riding scrubbers are known for use with hard floor surfaces, and in a presently preferred embodiment, the power scrubber 10 is an adaptation of Model 7100 offered by the Tennant Company of Minneapolis, Minn. These scrubbers are provided with a power brush platform 22 that may be lowered by the operator when in use and then raised when in transit. The brush platform 22 will accommodate either disc or cylindrical brushes; with a gravity feed system providing a cleaning solution that is released into the brushes/discs as they rotating. Additionally, although not shown in FIG. 1, as originally equipped, the power scrubber 10 is provided with a rear squeegee that may also be raised and lowered by the operator.

Carpeted surfaces are entirely different from hard floor surfaces in the context of their cleaning and maintenance. In order to provide the desired deep cleaning it is necessary to utilize considerably more cleaning solution, and its even placement is critical in comparison to a hard surface, over which liquid solutions can easily flow. In FIG. 1, a liquid spray manifold 28 is attached to the power brush platform 22, permitting it to be lowered to a position adjacent the carpeting (not shown in FIG. 1).

The spray manifold 28 is provided with a plurality of spray nozzles 32 (only one clearly depicted in FIG. 1), assuring an even application of cleaning solution over the length of the manifold 28. A manifold pump 36 is provided to replace the previous gravity feed, enabling the delivery of sufficient cleaning solution to the spray manifold 28 through a manifold supply line 38. A pair of feeder lines 42 supply cleaning solution to the manifold pump 36 from a cleaning solution reservoir (not shown) located within the power scrubber 10. A pair of power cords 44 provides electrical power from an on-board battery (not shown) to the manifold pump 36. Control over the operation of the manifold pump 36 is preferably obtained by a manual switch (not shown) located in a position that is convenient to the operator.

Immediately adjacent to and behind (in the context of a forward direction of travel) lies a pair of cylindrical scrub brushes 52. Supported at points of attachment (not shown) to the power brush platform 22, the scrub brushes 52 are caused to counter-rotate relative to one-another by a brush motor 56. In this manner, the cleaning solution is driven further into the carpeting by the first of the scrub brushes 52, and then "lifted out," along with any deeply imbedded particulate contaminants, by the trailing brush. An outer sealing rail 58 is located along either side of the power brush platform 22 to contain the cleaning action within the area worked by the scrub brushes 52.

In this manner, and with the power brush platform 22 lowered into position, cleaning solution applied through the spray manifold 28 is worked into the carpeting located within and between the outer sealing rails 58 by the counter-rotating scrub brushes 52. The majority of the cleaning solution is then removed from the carpet using a vacuum blower 64 that is contained within the power scrubber 10.

The suction created by the blower 64 is applied to the carpeting through a pair of vacuum shoes 68 that are in fluid communication with the vacuum blower 64 through a vacuum manifold 72. The lifted cleaning solution flows through an intake hose 74 to a holding tank 78 (shown in FIG. 2) located within the power scrubber 10.

To maximize the suction being applied to the carpeted floor, it is important that the vacuum shoes 68 are maintained in close contact with the floor at all times. The power scrubber applies a downward pressure on the shoes 68 through the same mechanism that raises and lowers the shoes 68 into position. However, since dips and ridges exist in virtually every floor, it is essential that the shoes 68 be able to independently move relative to one another. A connecting bar 84 is attached to each shoe 68 in a hinged connection, permitting each of the shoes 68 to articulate relative to one another (mutual articulation), thus maintaining each in close contact with the carpeting (not shown in FIG. 1).

Figure 2:
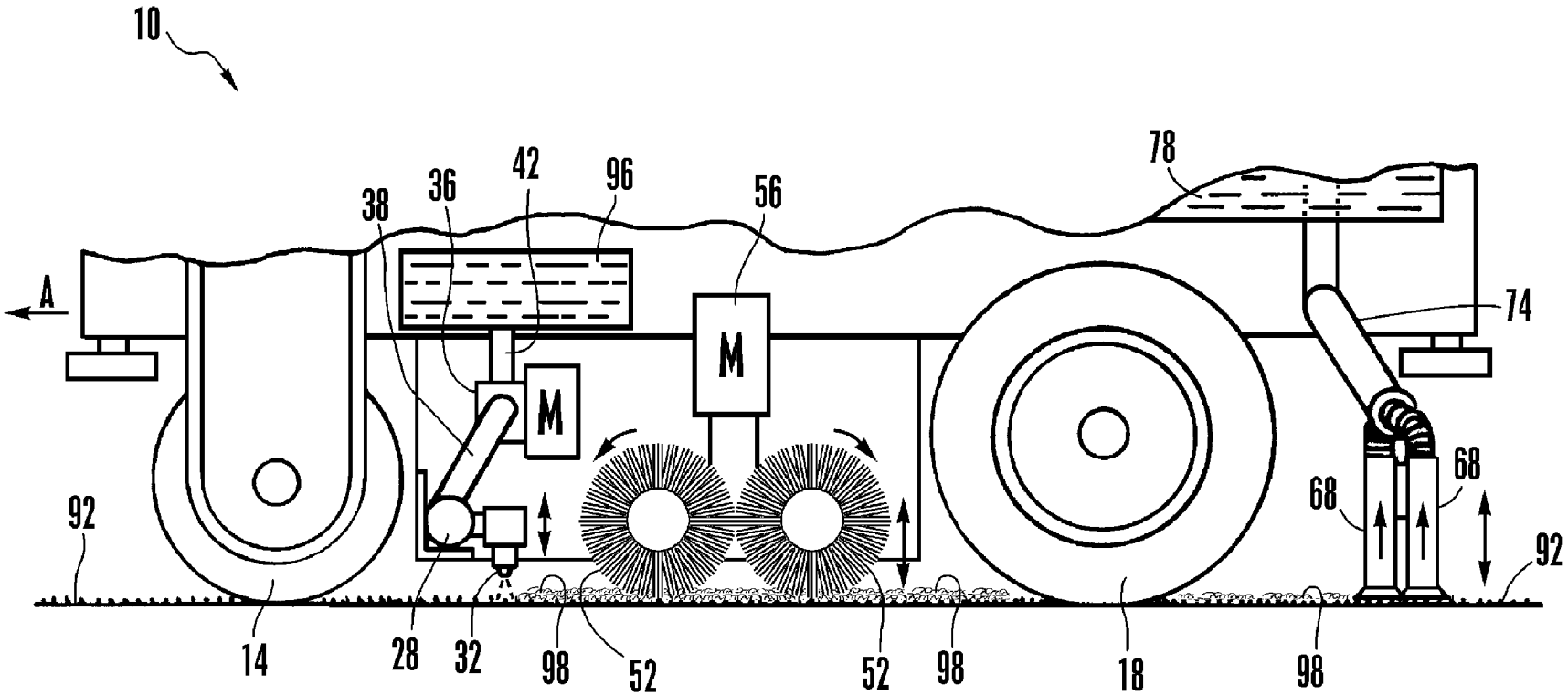
FIG. 2 is a partial elevation view showing a manner of operation of the modified power scrubber in accordance with the present invention.

The manner of operation of the power scrubber 10 in accordance with the present invention is best shown in FIG. 2. The power scrubber 10 rests upon a carpeted surface 92. When in a cleaning mode, the power scrubber 10 moves along the carpeted surface in the direction of arrow A. Additionally, the power brush platform 22 is in the lowered position depicted in FIG. 2, placing both the liquid spray manifold 28 and the scrub brushes 52 adjacent the carpet 92.

A cleaning solution reservoir 96 is provided within the body of the power scrubber 10, with appropriate hoses to allow cleaning solution stored within to flow to the manifold pump 36 upon its activation by the operator. From there the fluid is pushed through the manifold supply line 38, into the liquid spray manifold 28, and out through the plurality of spray nozzles 32 and into the carpet 92.

A layer of cleaning solution 98 is depicted as being formed on the carpet 92 as a result of such sprayed application. The pair of scrub brushes 52 interacts with the cleaning solution layer 98 and the carpet 92 to provide sufficient agitation to loosen built-up dirt and soiling agents and suspend them in the layer of cleaning solution 98. The vacuum blower 64 removes this layer of cleaning solution and suspended soiling agents, with the suction applied to the carpet 92 through the pair of vacuum shoes 68. The cleaning solution and associated contaminants are conveyed from the vacuum blower 64 pair of vacuum shoes 68 to a holding tank 78 through the intake hose 74.

The application, agitation, and pickup of the cleaning solution are critical to the proper functioning of the power scrubber 10. In a preferred embodiment, the manifold pump preferably provides a 2-gallons/minute rate of flow at 70 to 100 psi. A suitable pump matching such requirements is a 36-volt pump marketed by Shurflo Pump Manufacturing Company of Santa Ana, Calif., as Flow-Jet Model 02135332A.

The even, continuous application of the cleaning solution to the carpeting is preferably obtained through the use of a 6-jet manifold spray bar having overall dimensions 15⅞ inches by 6¾ inches by 1 inch. The orifice size of each jet is preferably 0.015 inches, and the jets are each set at an angle of 110 degrees to the horizontal. The manifold may be fabricated utilizing available parts, such as the spray bar offered in Tennant Part No. 230407, and the nozzles provided on Spray Bar Tennant Model No. 230407 (Tennant Company of Holland, Mich.).

A carpeted surface requires a specific type of brush, one that will gently agitate the fibers, and not the abrasive type of force need for smooth surfaced floors. A suitable brush for this task would be a cylindrical brush of 4 inches in diameter and 28 inches in length. A blended black polypropylene and white Nylon (gauges: Black 0.020; white 0.025) of alternating black and white rows is suitable for the majority of carpeted surfaces. These types of brushes are available from, among others, Flo-Pac Corporation of Fontana, Calif.

It is important that the carpeting be thoroughly dry before returned to service, and the greater the amount of cleaning solution that is removed, the faster such drying will occur.

The vacuum motors designed for smooth surface floors are not sufficient for carpeted surfaces. A preferred vacuum motor for carpeting would be a 36-volt, 3 stage motor providing 110 inches of water lift. Such a motor may be obtained from Nilfisk Advance, Inc., of Plymouth, Minn. The vacuum shoes through which the vacuum is applied to the carpeting may be fabricated out of urethane or stainless steel of 21 inches in width. When the two shoes are positioned together, they create a combined vacuum pickup area of 32 inches in length and ½ inch deep (wide). Our invention has been disclosed in terms of a preferred embodiment thereof, which provides a riding scrubber capable of cleaning carpeted surfaces that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. A scrubbing machine for scrubbing a carpeted floor surface comprising:

a frame;

means to move said scrubbing machine along said carpeted floor surface in a manner defining a path of movement;

a pair of surface engaging rotary tools mounted on said frame for rotation about parallel axes, said axes extending transversely to said path of movement;

at least one spray nozzle mounted on the frame for applying a scrubbing liquid to said carpeted floor surface in said path of movement in advance of said rotary tools; and means mounted on said frame for collecting said scrubbing liquid after application of same to said carpeted floor surface, said collecting means including a pair of surface engagable vacuum shoes, wherein each of said pair of vacuum shoes are attached to one another in a manner forming a hinged connection permitting each of said pair of vacuum shoes to articulate relative to one another.

* * * * *